US008061170B2

(12) United States Patent
Calor et al.

(10) Patent No.: US 8,061,170 B2
(45) Date of Patent: Nov. 22, 2011

(54) KEY WITH RETRACTABLE STEM, COMPRISING MEANS FOR MOVING THE STEM INTO A DEPLOYED POSITION

(75) Inventors: Hervé Calor, Créteil (FR); Louis Canard, Créteil (FR)

(73) Assignee: Valeo Securite Habitacle, Créteil Cedex (FR)

( * ) Notice: Subject to any disclaimer, the term of this patent is extended or adjusted under 35 U.S.C. 154(b) by 488 days.

(21) Appl. No.: 11/578,014

(22) PCT Filed: Apr. 1, 2005

(86) PCT No.: PCT/EP2005/051475

§ 371 (c)(1),
(2), (4) Date: Oct. 10, 2006

(87) PCT Pub. No.: WO2005/108721

PCT Pub. Date: Nov. 17, 2005

(65) Prior Publication Data

US 2009/0113964 A1 May 7, 2009

(30) Foreign Application Priority Data

Apr. 8, 2004 (FR) ..... 04 03733

(51) Int. Cl.
*A44B 15/00* (2006.01)

(52) U.S. Cl. ..... 70/459; 70/408; 70/456 R

(58) Field of Classification Search ..... 70/408, 70/456 R, 459
See application file for complete search history.

(56) References Cited

U.S. PATENT DOCUMENTS

| | | | | | |
|---|---|---|---|---|---|
| 1,998,799 | A | * | 4/1935 | Woina et al. | 70/456 R |
| 2,248,436 | A | * | 7/1941 | Rivers | 70/456 R |
| 2,402,347 | A | * | 6/1946 | Rotheraine | 70/456 R |
| 2,451,056 | A | * | 10/1948 | Berger et al. | 70/456 R |
| 2,467,614 | A | * | 4/1949 | Duyn | 70/456 R |
| 2,472,337 | A | * | 6/1949 | Olson | 70/456 R |
| 2,593,441 | A | * | 4/1952 | Hager et al. | 70/456 R |
| 2,618,958 | A | * | 11/1952 | Goodson | 70/456 R |
| 2,795,128 | A | * | 6/1957 | Ly | 70/456 R |
| 2,836,053 | A | * | 5/1958 | Starrett | 70/456 R |
| 2,851,872 | A | * | 9/1958 | Stow | 70/456 R |
| 3,023,603 | A | * | 3/1962 | Bowen | 70/456 R |

(Continued)

FOREIGN PATENT DOCUMENTS

DE 39 02 537 8/1990

(Continued)

OTHER PUBLICATIONS

International Search Report for PCT/EP2005/051475 dated Nov. 4, 2005 (2 pages).

*Primary Examiner* — Suzanne Barrett
(74) *Attorney, Agent, or Firm* — Osha • Liang LLP

(57) ABSTRACT

The invention provides a key (10), of the type comprising a stem (14) which is retractable in relation to a case (12), in which the stem (14) comprises a lug (18), by means of which it is articulated in relation to the case (12), which comprises angular locking means (22) for locking the stem (14) in the retracted position and angular locking means (22) for locking the stem (14) in the deployed position,
characterized in that the locking means comprise a single locking element (22) mounted such that it can move inside the case (12), which co-operates directly with the lug (18) of the stem (14) in order to lock the stem (14) in the retracted or deployed position.

13 Claims, 5 Drawing Sheets

U.S. PATENT DOCUMENTS

| | | | | | |
|---|---|---|---|---|---|
| 3,079,784 | A * | 3/1963 | Pavlowski | 70/456 R |
| 3,173,280 | A * | 3/1965 | Oberacker | 70/456 R |
| 3,321,943 | A * | 5/1967 | Reyes | 70/456 R |
| 3,355,917 | A * | 12/1967 | Albert | 70/456 R |
| 3,436,942 | A * | 4/1969 | Procter | 70/456 R |
| 3,599,458 | A * | 8/1971 | Chow et al. | 70/459 |
| 3,696,649 | A * | 10/1972 | Chow et al. | 70/456 R |
| 4,045,984 | A * | 9/1977 | McDonald | 70/456 R |
| 4,524,594 | A * | 6/1985 | Bascou | 70/456 R |
| 4,569,215 | A * | 2/1986 | McCarthy | 70/456 R |
| 4,660,397 | A * | 4/1987 | Girimont | 70/456 R |
| 4,941,569 | A * | 7/1990 | Lindmayer et al. | 206/38.1 |
| 5,117,666 | A * | 6/1992 | Keefer | 70/456 R |
| 5,215,190 | A * | 6/1993 | Hoffpauir, Jr. | 206/37.2 |
| 5,937,681 | A * | 8/1999 | Myhr et al. | 70/456 R |
| 5,943,889 | A * | 8/1999 | Chiu | 70/456 R |
| 6,216,501 | B1 * | 4/2001 | Marquardt et al. | 70/252 |
| 6,460,386 | B1 * | 10/2002 | Watanuki et al. | 70/456 R |
| 6,499,326 | B1 * | 12/2002 | Heussner | 70/399 |
| 6,647,752 | B1 * | 11/2003 | Chaillie | 70/456 R |
| 6,705,141 | B1 * | 3/2004 | Jacob et al. | 70/408 |
| 6,892,558 | B2 * | 5/2005 | Chodosh | 70/456 R |
| 7,055,352 | B2 * | 6/2006 | Meyerson et al. | 70/456 R |
| 7,127,922 | B2 * | 10/2006 | Khounsombath et al. | 70/456 R |
| 7,370,501 | B2 * | 5/2008 | Miyata et al. | 70/395 |
| 7,513,134 | B2 * | 4/2009 | Hashimoto et al. | 70/456 R |
| 7,596,977 | B2 * | 10/2009 | Eychenne et al. | 70/257 |
| 2003/0000267 | A1 * | 1/2003 | Jacob et al. | 70/399 |

FOREIGN PATENT DOCUMENTS

| | | |
|---|---|---|
| DE | 42 38 042 | 5/1994 |
| DE | 198 20 831 | 8/1999 |
| EP | 1526232 A1 | 4/2005 |
| FR | 2 816 976 | 5/2002 |

* cited by examiner

[Fig. 1]
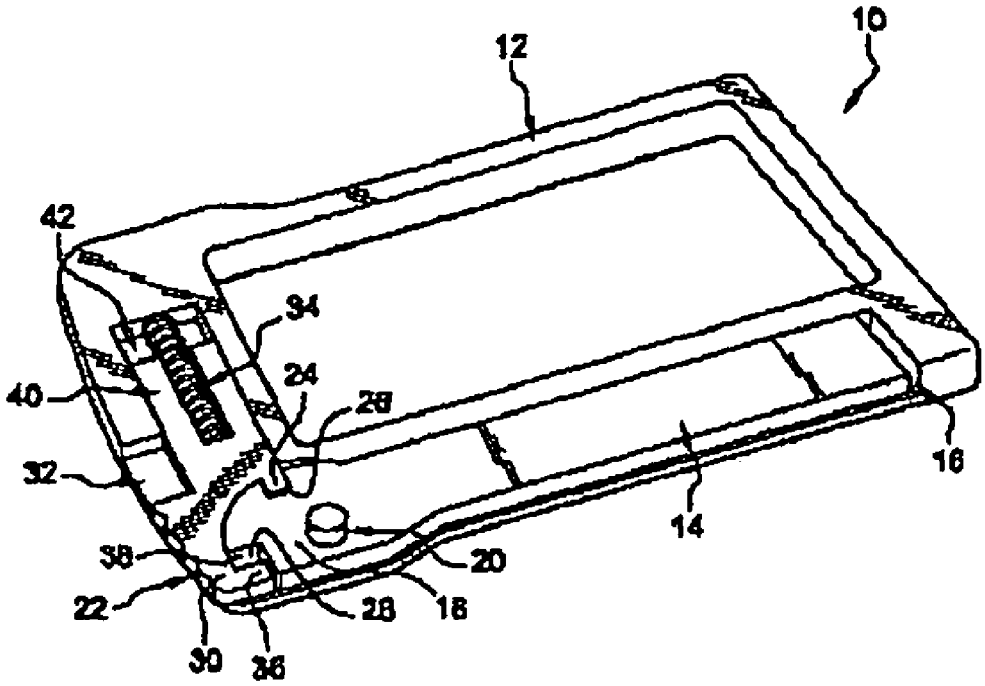
[Fig. 2A]
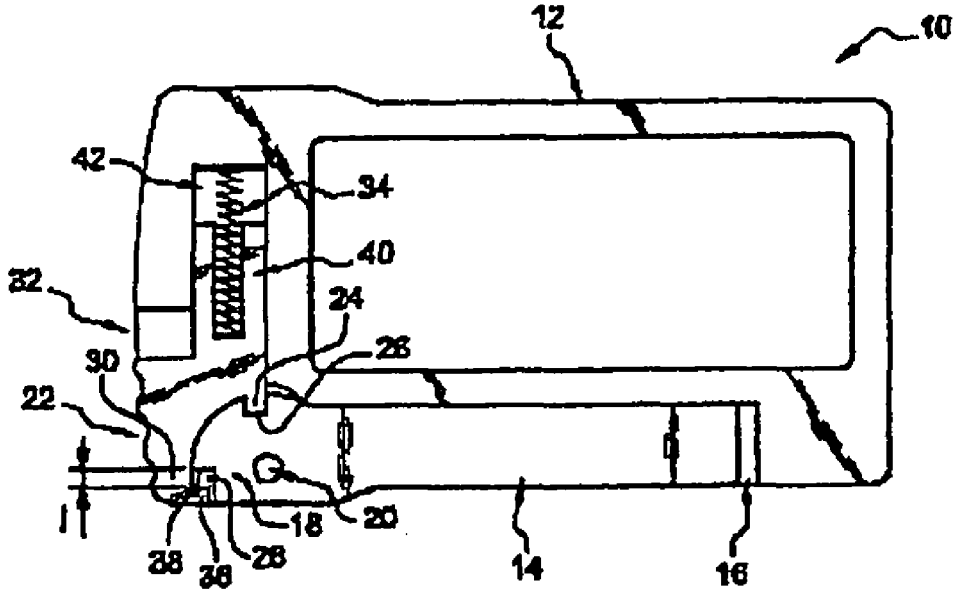

[Fig. 2B]
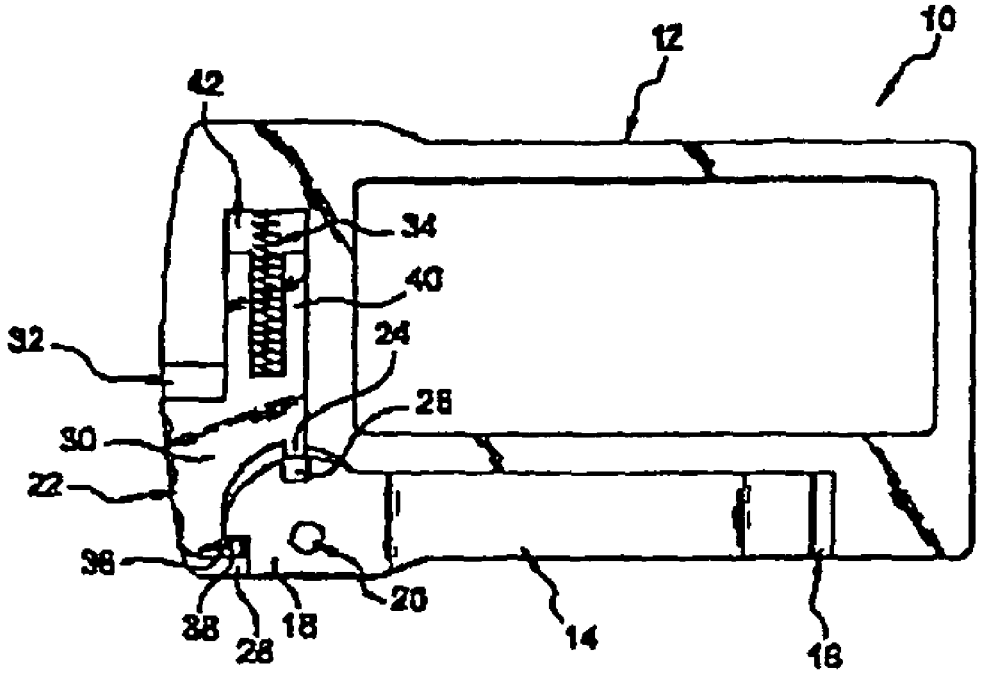
[Fig. 2C]
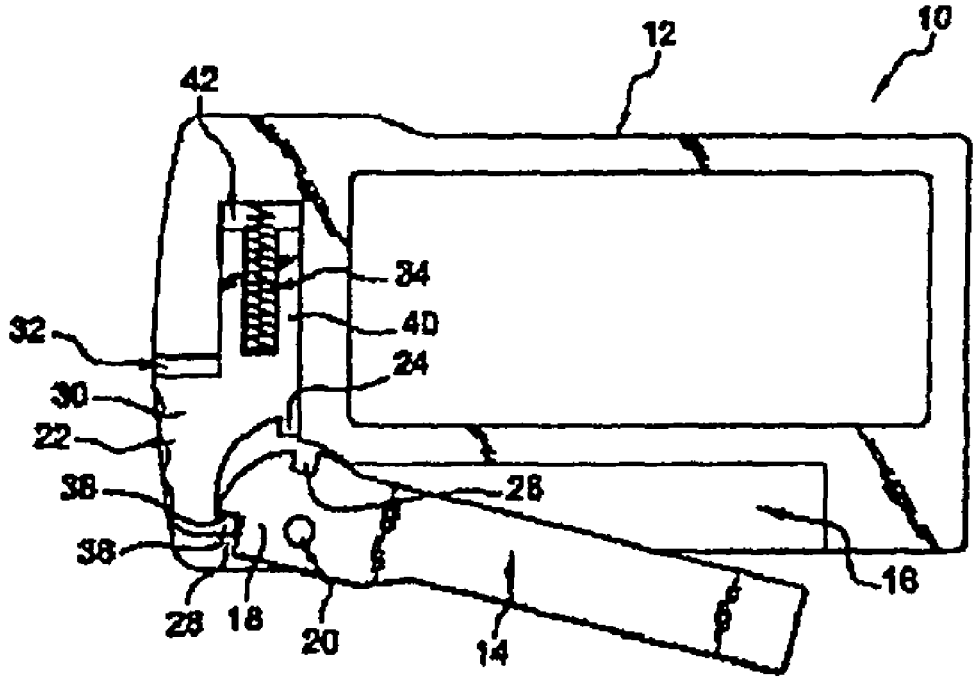

[Fig. 2D]
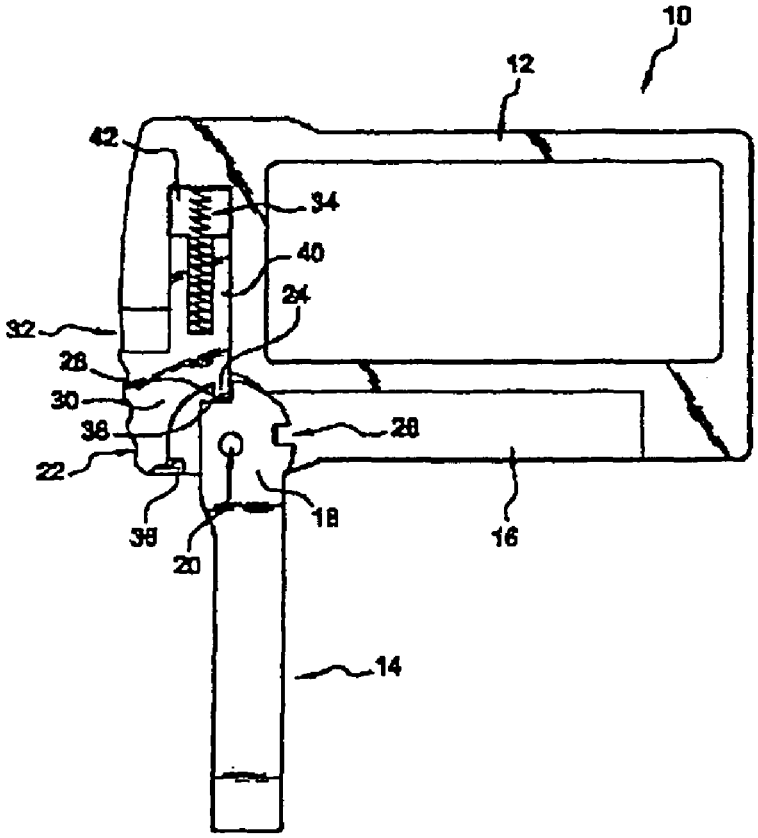
[Fig. 3]
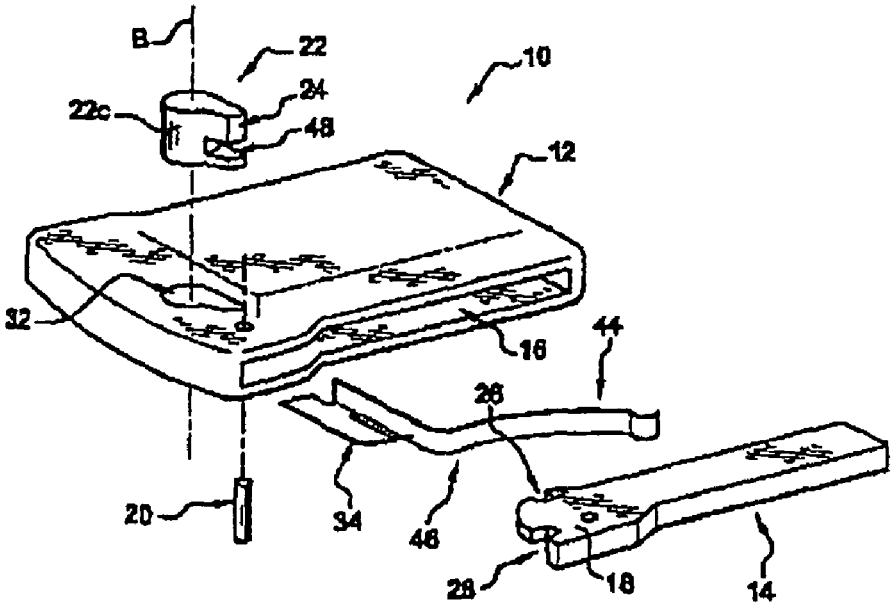

[Fig. 4]
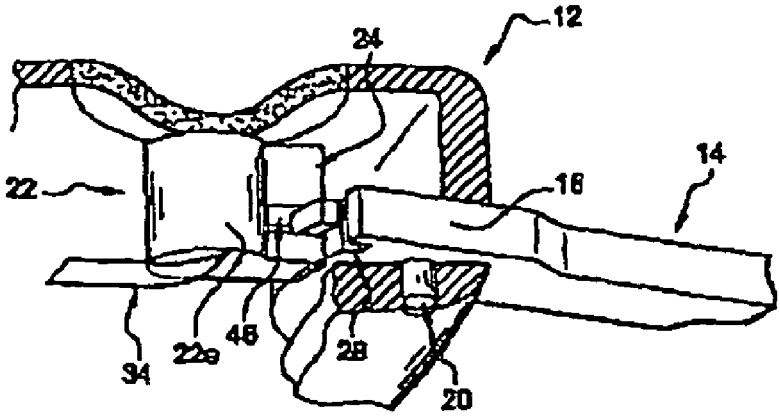
[Fig. 5A]
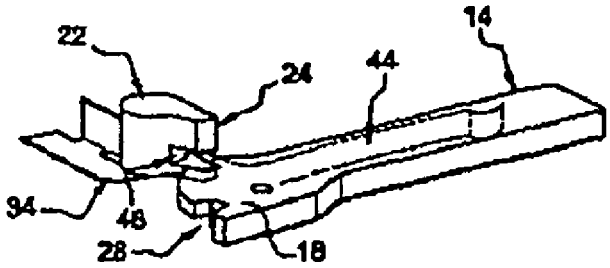
[Fig. 5B]
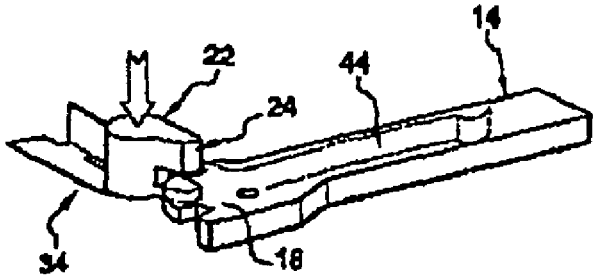
[Fig. 5C]
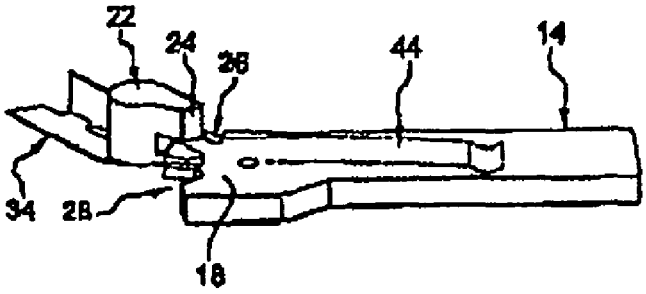

[Fig. 5D]
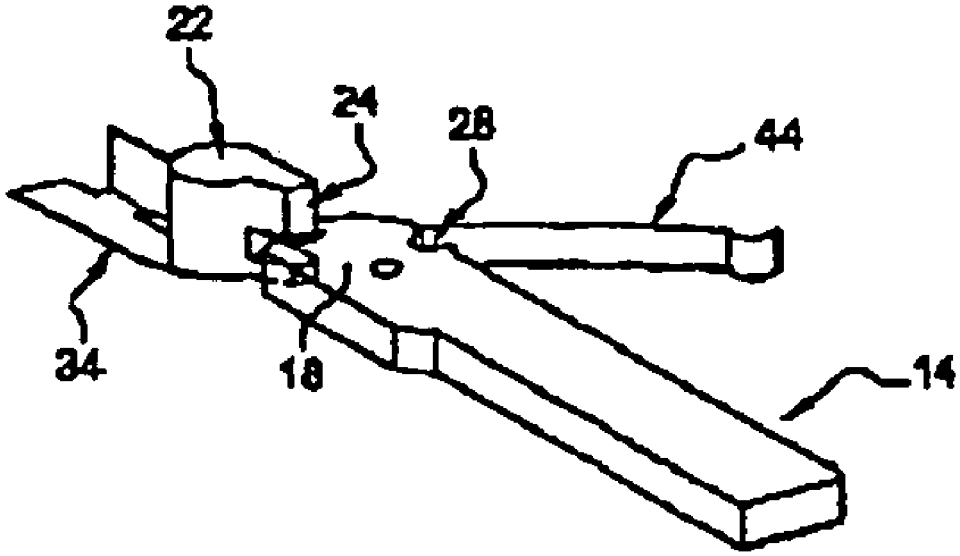
[Fig. 5E]
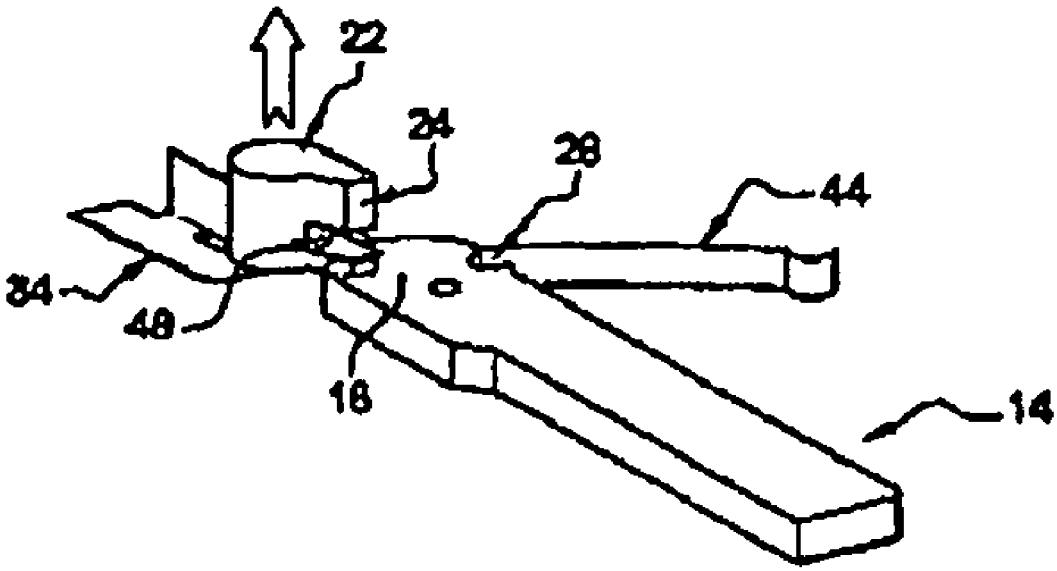

KEY WITH RETRACTABLE STEM, COMPRISING MEANS FOR MOVING THE STEM INTO A DEPLOYED POSITION

The invention relates to a key comprising a retractable stem inside the key-head.

The invention relates more specifically to a key, especially a motor vehicle key, of the type comprising a retractable stem which is mounted such that it can pivot in relation to a case forming a head for manipulating the key, between a retracted position in which the stem lies in a generally longitudinal direction inside a recess in the case, and a deployed operating position in which at least a section of the stem of the key lies outside the case, Of the type of in which the stem comprises a first end forming a lug, by means of which it is articulated in relation to the case about a vertical hinge pin at right angles to the axis of the stem, and Of the type of which comprises, angular locking means for locking the stem in the retracted position and angular locking means for locking the stem in the deployed position.

The assembly formed by the key-stem, also called an insert, and the key-head is relatively bulky, when the stem lies longitudinally outside the key-head.

In addition, when the key is placed in the pocket of a garment, the key-stem is likely to cause premature wear of this pocket, even making a hole, which is very detrimental.

In order to limit this disadvantage, means have been provided for retracting the stem inside the case forming the key-head.

The document DE-A-39.02.537 describes a key comprising a retractable stem, in which the movement of the stem from its retracted position to its deployed operating position is automatic.

The stem is hinge-mounted inside the case by means of an articulation element in which are arranged means for locking the stem in position, as well as the means for moving the stem into its deployed position.

Such a stem mounting therefore requires the use of a great number of components which are also relatively bulky.

These components occupy a large volume inside the head-case, and they greatly reduce the case volume available for arranging an electronic device in it, used, for example, to remotely control the locking of the vehicle's doors.

The object of the invention is to provide a key comprising a retractable stem, for which the number of components required for the articulation of the stem in relation to the case, and for moving the stem into a deployed position, is reduced.

With this object in view, the invention provides a key of the type previously described, characterized in that the locking means comprise a single locking element mounted such that it can move inside the case, which co-operates directly with the lug of the stem in order to lock the stem in the retracted or deployed position.

According to other features of the invention:

- the locking element is mounted such that it can move in the case between an unlocking position allowing pivoting of the stem, and a single locking position in which it co-operates with the lug of the stem in order to lock the stem in the retracted or deployed position.
- the locking element comprises a transverse finger which can be received by a first radial notch in the lug of the stem, for the angular locking of the stem in the retracted position, and which can be received by a second radial notch in the lug of the stem, for angular locking of the stem in the retracted position.

- the key comprises an elastic return element to return the locking element to its single locking position.
- the locking element comprises a manipulation element which lies partly outside the case, for manually moving the locking element from its locking position to its unlocking position.
- the key comprises means for moving the stem from the retracted position into an intermediate position in which the stem lies at least partly outside the recess.
- the means for moving the stem comprise an actuator finger which is integral with the locking element, and which co-operates with a vertical radial surface of the lug in order to move the stem.
- the radial surface of the lug is a portion of the second notch in the lug.
- the means for moving comprise an elastic actuator element which exerts an actuating force on the stem when the stem is in the retracted position.
- the elastic actuator element and the elastic return element are two portions of a single elastic spring.
- the elastic spring is made by cutting and bending a metal strip.
- the locking element is mounted such that it can slide inside the case.
- a portion of the locking element is guided as it slides in a complementary recess in the case.
- the locking element is mounted such that it can slide in a transverse horizontal direction.
- the locking element is mounted such that it can slide in a generally vertical direction between a high locking position and a low unlocking position of the stem.

Other features and advantages of the invention will emerge from the reading of the detailed description which follows, for the understanding of which reference will be made to the attached drawings, in which:

FIG. 1 is a diagrammatical representation in perspective of a key comprising locking means according to the invention;

FIGS. 2A to 2D are top views of the key illustrated in FIG. 1, illustrating various operating positions of the locking element and the stem;

FIG. 3 is an exploded perspective view of a key according to a different embodiment of the invention;

FIG. 4 is a larger scale cutaway detail drawing of the locking element; and

FIGS. 5A to 5E are perspective views, illustrating various positions of the locking element and the stem of the key illustrated in FIG. 3.

For the description of the invention, the vertical, longitudinal and transverse orientations are taken in a non-limiting manner according to the indications V, L and T shown on the figures.

The front-to-rear orientation is also taken as being the longitudinal direction from left to right with reference to FIG. 1.

In the description which follows, items which are the same, similar or analogous are assigned the same reference numbers.

FIG. 1 illustrates a key 10 which is used to operate the mechanism of a motor vehicle lock with a barrel (not shown), which comprises a case 12 and a key-stem 14, also called an insert.

The key 10 also comprises an electronic device (not shown) which is fitted inside the case 12.

The case 12 forms the head of the key 10 and is used to manipulate the key 10, in particular for turning it in the barrel of the lock, about the longitudinal axis of the stem 14.

The stem 14 is mounted such that it can pivot in relation to the case 12 between a retracted position illustrated in FIG. 2, in which the stem lies inside a recess 16 in the case 12, according to a generally longitudinal orientation, and a deployed operating position, illustrated in FIG. 5, in which the stem 14 lies partly outside the case 12.

Here, when the stem 14 is in the deployed position, it lies according to a generally transverse orientation, that is to say that it has turned through an angle of 90 degrees in relation to its retracted position. However, it will be understood that the invention is not limited to this embodiment and that the stem can turn through a larger or smaller angle in relation to its retracted position, in particular a 180-degree angle, in which case the stem 14 lies according to a generally longitudinal orientation outside the case 12.

The articulation of the stem 14 in relation to the case 12 is achieved by means of a first end 18 of the stem 14 forming a lug, which is here the front longitudinal end of the stem 14, through which a vertical pin 20 passes.

The recess 16, in which the stem 14 is received when it is in the retracted position, is located on one lateral edge of the case 12, here the left-hand lateral edge, and it is open and opens out toward the outside along the left-hand lateral edge, in order to allow the passage of the stem 14 from or to its deployed position.

Finally, the key 10 comprises means for locking the stem 14 when it is in the retracted position and means for locking the stem 14 when it is in the deployed position.

According to the invention, these locking means comprise a single locking element 22 which is mounted such that it can move inside the case 12, and which is able to co-operate directly with the lug 18 of the stem 14 in order to lock the stem 14 in the retracted or deployed position.

The locking element 22 comprises for this purpose a locking finger 24 which is able to be received selectively by a first radial notch 26 in the lug 16, in order to lock the stem 14 in the retracted position, as illustrated in FIG. 2, or by a second notch 28 in the lug 16, in order to lock the stem 14 in the deployed position, as illustrated in FIG. 5.

In order to allow the stem 14 to pivot in relation to the case 12, the locking element 22 is mounted such that it can move in relation to the case 12 between its locking position, in which the locking finger 24 is received selectively by the first notch 26 or by the second notch 28, and an unlocking position in which the locking finger 24 lies outside both radial notches 26, 28.

The movement of the locking element 22 from its locking position to its unlocking position is activated manually by the user of the key 10, by means of a manipulation element 30 which is a portion of the locking element 22, and which lies partly outside the case 12.

Here, the manipulation element 30 passes through an opening 32 in the case 12, which is made in the front longitudinal end edge of the case 12.

However, the movement of the locking element 22 from its unlocking position to its locking position is activated by means of an elastic return element, or return spring 34.

Therefore, when the user controls the unlocking of the stem 14, he acts on the manipulation element 30, against the elastic return force exerted by the return spring 34 on the locking element 22.

When the stem 14 is in the retracted position in the recess 16 in the case 12, it is difficult to grasp it manually in order to then make it pivot into its deployed position.

That is why the key 10 comprises means for moving the stem 14 from its retracted position to an intermediate position, in which a portion of the stem 14 lies outside the recess 16.

FIGS. 1 to 2D illustrate a first embodiment of the invention according to which the means for moving the stem 14 comprise an actuator finger 36 integral with the locking element 22, and which is able to co-operate with the lug 18 of the stem 14.

Here, the actuator finger 36 bears against a vertical bearing surface 38 on the lug 18, which lies radially in relation to the hinge pin 20, in order to move the stem 14.

When the locking element 22 is in the locking position, as can be seen in FIG. 2, the actuator finger 36 lies at a certain distance from the bearing surface 38. This clearance j which exists between the actuator finger 36 and the bearing surface allows the locking finger 24 to come out of the first notch 26, before the locking element 22 moves the stem 14.

According to a preferred embodiment of the invention, the vertical bearing surface 38 is a portion of the second notch 28.

The locking element 22 is mounted such that it can move laterally in relation to the case 12 in a transverse horizontal direction, and it comprises a portion 40 of generally cylindrical shape, with a transverse main axis, which is guided laterally in a complementary transverse recess 42 in the case 12.

In order to move the stem 14 out from its retracted position toward its deployed position, in a first movement illustrated in FIG. 2A, the user of the key 10 acts on the manipulation element 30 in order to cause the locking element 22 to move from its locking position to an intermediate position illustrated in FIG. 2B.

In this intermediate position, the locking finger 24 has come out of the first notch 26, and the actuator finger 36 is bearing on the bearing surface 38 of the lug 18.

The locking finger 24 having come out of the first notch, the stem 14 is then able to pivot in relation to the case 12.

Next, as illustrated in FIG. 2C, the user continues to act on the manipulation element 30 so as to cause an additional movement of the locking element 22, beyond the intermediate position, until the locking element reaches the end of its travel, for example by the abutment of the manipulation element 30 against one edge of the opening 32.

This additional movement of the locking element 22 then causes the pivoting of the stem 14 about the pin 20, by the co-operation of the actuator finger 36 with the bearing surface 38.

The user can then release the manipulation element 30, the spring 34 then causes the locking element to return to its locking position, until the locking finger abuts against the cylindrical external surface 18*e* of the lug 18.

Finally, the user grasps the portion of the stem 14 which lies outside the recess 16, in order to pivot the stem manually into its deployed operating position illustrated in FIG. 2D.

During this manual movement of the stem 14, the second notch 28 comes opposite the locking finger 24, the locking finger 24 is then inserted in the second notch 28, when acted on by the elastic return spring 34, thereby locking the stem 14 in the deployed position.

In order to pivot the stem 14 from its deployed position into its retracted position, the user acts on the manipulation element by causing the movement of the locking element 22 so that the locking finger 24 comes out of the second notch 28.

Next, the user manually pivots the stem 14 into its retracted position and releases the pressure on the manipulation element, in order to allow the locking finger 24 to enter the first notch when the stem 14 is in its retracted position.

FIGS. 3 to 5E illustrate a different embodiment of the invention according to which the means for moving the stem 14 comprise an elastic actuator element 44, which exerts on the stem 14 an elastic actuating force for moving the stem into an intermediate position, when the stem 14 is in the retracted position.

Thus, after the user has acted on the locking element 22, so as to cause the locking finger 4 to come out of the first notch 26, the actuator element 44 automatically causes a portion of the stem 14 to come out, as represented in FIG. 7.

The user can then grasp the stem 14 in order to pivot it into its deployed position represented in FIG. 8.

Here, as shown in FIG. 3, the elastic actuator element 44 and the return spring 34 are two portions of a single elastic spring 46, which is made by cutting and bending a metal strip.

In addition, the locking element 22 here consists of a generally cylindrical element with a vertical main axis, which is mounted such that it can slide in relation to the case 12 in a generally vertical direction in a complementary cylindrical recess in the case 12, of which the main axis B is offset in relation to the hinge pin 20 of the stem 14.

The locking finger 24 lies radially vertically along a vertical line generated by the cylindrical external surface 22*e* of the locking element 22.

The locking element 22 is mounted such that it can slide in relation to the case 12 between a raised locking position illustrated in FIG. 5A, and a low unlocking position illustrated in FIG. 5B.

In order to carry out unlocking when the locking element 22 is in the unlocking position, that is to say so that the locking finger 24 does not co-operate with the first notch 26 or the second notch 28, the locking finger comprises a cut-out 48 through which the lug 18 of the stem 14 passes during the pivoting of the stem 14 about the pin 20.

In order to be able to activate the locking element 22 manually, the guiding recess 42 of the locking element 22 is open at its upper end, so that the upper end of the locking element partly protrudes outside the case 12 in order to be able to be activated manually, like a push-button.

In order to return the locking element 22 to its locking position, the return spring 34 is also in the form of a metal blade which is arranged underneath the locking element, and therefore exerts a return force oriented vertically upward.

FIGS. 5A to 5E illustrate the various operating stages of the key 10.

FIG. 5A illustrates the stem 14 in its initial state, that is to say when it is folded inside the recess 16.

According to a first movement illustrated in FIG. 5B, the user presses the locking element 22, so as to move it downward, until the cut-out 48 is level with the lug 18.

The stem 14 is then no longer prevented from pivoting, therefore the blade 44 moves it outside the recess 16, as illustrated in FIG. 5C.

Next, as can be seen in FIG. 5D, the user manually moves the stem 14 into its deployed position, that is to say until the second notch 28 comes opposite the stop finger 24.

Then, as can be seen in FIG. 5E, and in a last movement, the locking element 22 is moved upward by the return spring 34, so that the stop finger 24 is received by the second notch 28, thereby locking the stem 14 in its deployed position.

In order to pivot the stem 14 from its deployed position into its retracted position, the user first acts on the locking element 22 so as to move it downward, until the cut-out 48 is level with the lug 18.

Next, the user manually pivots the stem 14 into its retracted position, against the elastic return force of the blade 44, then he releases the pressure on the locking element 22.

The locking finger 24 is then able once again to enter the first notch 26, thereby locking the stem in the retracted position.

Such a key 10 thus comprises a relatively number of components for moving the stem into its deployed position.

This small number of components makes it possible to arrange these components in a portion of a single half-shell of the case 12, making a larger portion of the internal volume of the case available for arranging the electronic device.

In addition, this small number of components simplifies the manufacture of the key 10, not only with regard to the design of the various components, but also with regard to their assembly.

The cost of producing the key is consequently also reduced.

Finally, in spite of the fact that the actuator mechanism according to the second embodiment of the invention is more bulky vertically, it is also easier to use.

Effectively, the locking element 22 is operated only by means of vertical pressure, in the same manner that the user presses one of the electronic device buttons.

The invention claimed is:

1. A key for a motor vehicle comprising:

a retractable stem mounted so as to pivot in relation to a case forming a head for manipulating the key, between a retracted position in which the stem lies in a generally longitudinal direction inside a recess in the case, and a deployed operating position in which at least a section of the stem of the key lies outside the case, wherein the case comprises an electronic device fitted inside the case, the retractable stem comprising:

a first end forming a lug, by means of which the stem is articulated in relation to the case about a vertical hinge pin at right angles to an axis of the stem, angular locking means for locking the stem in one of the retracted position and the deployed position, wherein the angular locking means comprise a single locking element mounted so as to move inside the case, wherein the single locking element co-operates directly with the lug of the stem to lock the stem in the retracted or deployed position, and wherein the locking element is mounted so as to slide in a transverse horizontal direction with respect to the vertical hinge pin, and wherein the locking element is guided in a complementary recess having said transverse horizontal sliding direction in the case, and wherein the complementary recess comprises a closed end.

2. The key as claimed in claim 1, wherein the locking element is mounted so as to move in the case between an unlocking position allowing pivoting of the stem, and a single locking position in which the locking element co-operates with the lug of the stem to lock the stem in the retracted or deployed position.

3. The key as claimed in claim 2, wherein the locking element comprises a transverse finger configured to be received by a first radial notch in the lug of the stem, for the angular locking of the stem in the retracted position, and configured to be received by a second radial notch in the lug of the stem, for the angular locking of the stem in the deployed position.

4. The key as claimed in claim 2, further comprising an elastic return element to return the locking element to the single locking position.

5. The key as claimed in claim 2, wherein the locking element comprises a manipulation element which lies partly outside the case, for manually moving the locking element from the single locking position to the unlocking position.

6. The key as claimed in claim 1, further comprising means for moving the stem from the retracted position into an intermediate position in which the stem lies at least partly outside the recess.

7. The key as claimed in claim 6, wherein the means for moving the stem comprise an actuator finger which is integral with the locking element and configured to co-operate with a vertical bearing surface of the lug to move the stem, and wherein the vertical bearing surface lies radially in relation to the vertical hinge pin.

8. The key as claimed in claim 7, wherein the vertical bearing surface of the lug is a portion of the second notch in the lug.

9. The key as claimed in claim 6, wherein the means for moving comprise an elastic actuator element which exerts an actuating force on the stem when the stem is in the retracted position.

10. The key as claimed in claim 9, wherein the elastic actuator element and an elastic return element are two portions of a single elastic spring.

11. The key as claimed in claim 10, wherein the elastic spring is made by cutting and bending a metal strip.

12. The key as claimed in claim 1, wherein the locking element is mounted so as to slide inside the case.

13. The key as claimed in claim 12, wherein a portion of the locking element is guided as the locking element slides in a complementary recess in the case.

* * * * *